US009089956B2

(12) United States Patent
Arimura et al.

(10) Patent No.: US 9,089,956 B2
(45) Date of Patent: Jul. 28, 2015

(54) IMPACT POWER TOOL

(75) Inventors: Tadashi Arimura, Kyoto (JP); Mitsumasa Mizuno, Takatsuki (JP); Toshiharu Ohashi, Maibara (JP); Masaaki Sakaue, Hikone (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1069 days.

(21) Appl. No.: 12/232,202

(22) Filed: Sep. 12, 2008

(65) Prior Publication Data

US 2009/0084568 A1 Apr. 2, 2009

(30) Foreign Application Priority Data

Sep. 28, 2007 (JP) ..... 2007-255837

(51) Int. Cl.
*E21B 4/12* (2006.01)
*B25B 23/14* (2006.01)
*B25B 23/147* (2006.01)

(52) U.S. Cl.
CPC ..... *B25B 23/1405* (2013.01); *B25B 23/1475* (2013.01)

(58) Field of Classification Search
CPC ..... E21B 4/12
USPC ..... 173/2, 176, 183
See application file for complete search history.

(56) References Cited

U.S. PATENT DOCUMENTS

| | | | | |
|---|---|---|---|---|
| 5,154,242 | A * | 10/1992 | Soshin et al. | 173/178 |
| 5,289,885 | A | 3/1994 | Sakoh | |
| 6,371,218 | B1 * | 4/2002 | Amano et al. | 173/183 |
| 6,655,471 | B2 * | 12/2003 | Cripe et al. | 173/176 |
| 2003/0149508 | A1 | 8/2003 | Watanabe | |
| 2005/0109520 | A1 * | 5/2005 | Kawai et al. | 173/183 |
| 2005/0263304 | A1 * | 12/2005 | Sainomoto et al. | 173/2 |
| 2006/0118315 | A1 | 6/2006 | Suzuki et al. | |
| 2006/0185869 | A1 * | 8/2006 | Arimura | 173/176 |

FOREIGN PATENT DOCUMENTS

| | | |
|---|---|---|
| JP | 05-200677 | 8/1993 |
| JP | 07-314344 | 12/1995 |

OTHER PUBLICATIONS

Office Action in corresponding European Application 08016243.1-2316, dated Aug. 2, 2010.

* cited by examiner

*Primary Examiner* — Nathaniel Chukwurah
(74) *Attorney, Agent, or Firm* — Bacon & Thomas, PLLC

(57) ABSTRACT

An impact power tool includes an impact mechanism for applying a striking impact to an output shaft by using an output power of a motor. A strike detection unit detects the striking impact applied by the impact mechanism to obtain a striking timing and a striking speed detection unit calculates a striking speed from the striking timing obtained by the strike detection unit and a rotation angle of the motor obtained by a rotation angle detection unit. A control unit counts the number of striking impact detected by the strike detection unit and stops the motor if the number of striking impact reaches a predetermined strike number. The control unit is designed to correct the predetermined strike number when the striking speed obtained in the striking speed detection unit is equal to or lower than a specified striking speed.

8 Claims, 5 Drawing Sheets

IMPACT POWER TOOL

FIELD OF THE INVENTION

The present invention relates to an impact power tool, such as an impact wrench or an impact driver, for use in tightening (and loosening) threaded objects, e.g., bolts and nuts.

BACKGROUND OF THE INVENTION

An impact power tool is designed to perform a tightening task by applying a rotational striking impact to an output shaft (anvil) with a hammer rotated by a motor output power. Since the impact power tool is operable at a high speed and with an increased torque, it has been extensively used in construction sites, fabrication factories and so forth. Japanese Patent Laid-open Publication No. H5-200677 discloses an impact power tool in which a shutoff function for automatically stopping operation of the tool upon reaching a desired torque is realized by counting the number of strikes and then determining whether the number of strikes thus counted has reached a value corresponding to a desired tightening torque.

The maximum tightening force of the impact power tool is decided by the rotational speed of the hammer (i.e., the rotating speed of a motor) which in turn depends on the voltage of a driving power source. For that reason, if the shutoff is performed by using only the number of strikes, it may become impossible to manage the tightening torque of bolts and nuts in a process of a factory requiring such management. This is because the tightening torque is gradually reduced as the voltage of a battery used as a driving power source undergoes gradual reduction as a result of continuous operation.

SUMMARY OF THE INVENTION

In view of the above, the present invention provides an impact power tool capable of performing a tightening task with a stable tightening torque even when the voltage of a driving power source is reduced.

In accordance with an aspect of the present invention, there is provided an impact power tool including: an impact mechanism for applying a striking impact to an output shaft by using an output power of a motor; a strike detection unit for detecting the striking impact applied by the impact mechanism to obtain a striking timing; a rotation angle detection unit for detecting a rotation angle of the motor; a striking speed detection unit for calculating a striking speed from the striking timing obtained by the strike detection unit and the rotation angle of the motor obtained by the rotation angle detection unit; and a control unit for counting the number of striking impact detected by the strike detection unit and for stopping the motor if the number of striking impact reaches a predetermined strike number, wherein the control unit is designed to correct the predetermined strike number when the striking speed obtained in the striking speed detection unit is equal to or lower than a specified striking speed.

The striking speed is reduced as the power source voltage drops. In response to the reduction in the striking speed, the predetermined number of strikes is corrected to thereby prevent occurrence of an insufficient tightening torque.

Preferably, the control unit performs correction of the predetermined strike number by calculating deficient striking energy in such a way that the predetermined strike number is multiplied by the difference between the striking energy calculated from a first specified striking speed and the striking energy calculated from the striking speed detected, converting the deficient striking energy to a deficient strike number, and then adding the deficient strike number to the predetermined strike number.

This makes it possible to perform accurate correction without increasing costs.

The control unit may stop the motor and notify an operator of occurrence of an abnormality in the tightening torque, when the striking speed detected is equal to or lower than a second specified striking speed which is smaller than the first specified striking speed. Alternatively, the control unit may stop the motor and keep the motor unable to operate, when the striking speed detected is equal to or lower than a second specified striking speed which is smaller than the first specified striking speed.

In the impact power tool of the present invention, the tightening torque is reduced in response to the drop in the power source voltage, because the striking energy of one strike shows reduction even if the number of strikes remains unchanged. The striking energy of one strike has something to do with the striking speed. In the present invention, the striking speed is detected and the number of strikes is corrected dependent upon the striking speed thus detected. Thanks to this feature, it is possible to assure a stable tightening torque. Therefore, the impact power tool is effective in the operations requiring management of a tightening torque as in factories, etc.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, an embodiment of the present invention will be described with reference to the accompanying drawings.

Figure 2:
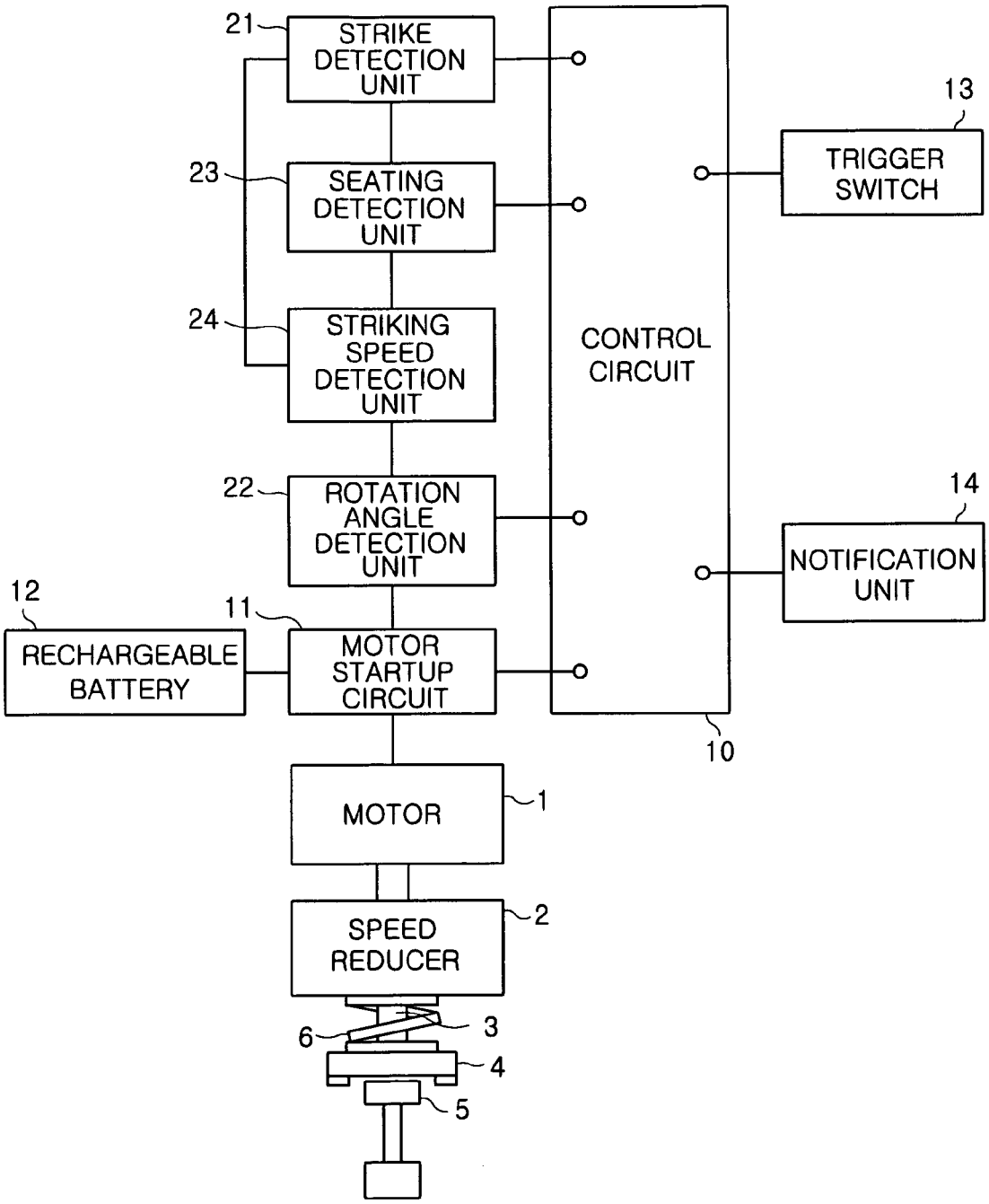
FIG. 2 is a block diagram showing the present impact power tool.

Reference numeral 1 in FIG. 2 designates a motor, the rotational output power of which is transferred to a driving shaft 3 through a speed reducer 2. A hammer 4 is connected to the driving shaft 3 through a cam mechanism (not shown). The hammer 4 engages with an anvil 5 having an output shaft and is biased toward the anvil 5 by means of a spring 6. The hammer 4, the anvil 5, the spring 6 and the cam mechanism cooperates to form an impact mechanism.

Since the hammer 4 and the anvil 5 are engaged with each other under the biasing force of the spring 6, the hammer 4 transfers rotation of the motor 1 to the anvil 5 as it is when no load is applied to the anvil 5. If a load torque grows higher, however, the hammer 4 moves backwards against the biasing force of the spring 6. As the engagement between the anvil 5 and the hammer 4 is released by the backward movement of the hammer 4, the hammer 4 rotates and moves forward under the biasing action of the spring 6 and under the guidance of the cam mechanism, thereby applying a rotational striking impact to the anvil 5.

Referring to FIG. 2, reference numerals 10, 11, 12 and 13 designate a control circuit, a motor driving circuit, a rechargeable battery serving as a driving power source and a trigger switch, respectively. The motor 1 is turned on and off by the operation of the trigger switch 13. The rotational speed of the motor 1 is changed depending on the operation amount of the trigger switch 13.

The impact power tool includes a strike detection unit 21 for detecting that the anvil 5 is struck by the hammer 4, a rotation angle detection unit 22 for detecting the rotation angle of the motor 1, a seating detection unit 23 and a striking speed detection unit 24. In the present embodiment, the seating detection unit 23 and the striking speed detection unit 24 are included in a calculation unit of the control circuit 10.

The strike detection unit 21 includes a microphone for catching a striking sound or an acceleration sensor for sensing a striking impact. The strike detection unit 21 detects the timing at which the striking impact is applied.

The rotation angle detection unit 22 serves to detect the rotation angle of the motor 1. In case the motor 1 is a brush motor, the rotation angle detection unit 22 includes a rotation sensor (e.g., a frequency generator) attached to the motor 1. In case the motor 1 is a brushless motor, the rotation angle detection means 22 includes a position detection sensor (a hall sensor) for detecting the position of a rotor.

The seating detection unit 23 serves to detect the seating of a nut or the head of a bolt on a target member. The seating is detected by estimating a tightening torque from the rotational speed of the motor 1 and the rotation amount of the motor 1 between two consecutive strikes and then determining whether the tightening torque thus estimated has reached a predetermined value.

In the present embodiment, the seating is judged based on the estimated tightening torque found by the above calculation, and the final tightening torque is judged by counting the number of strikes made after the seating. The reasons will be described later.

Figure 3:
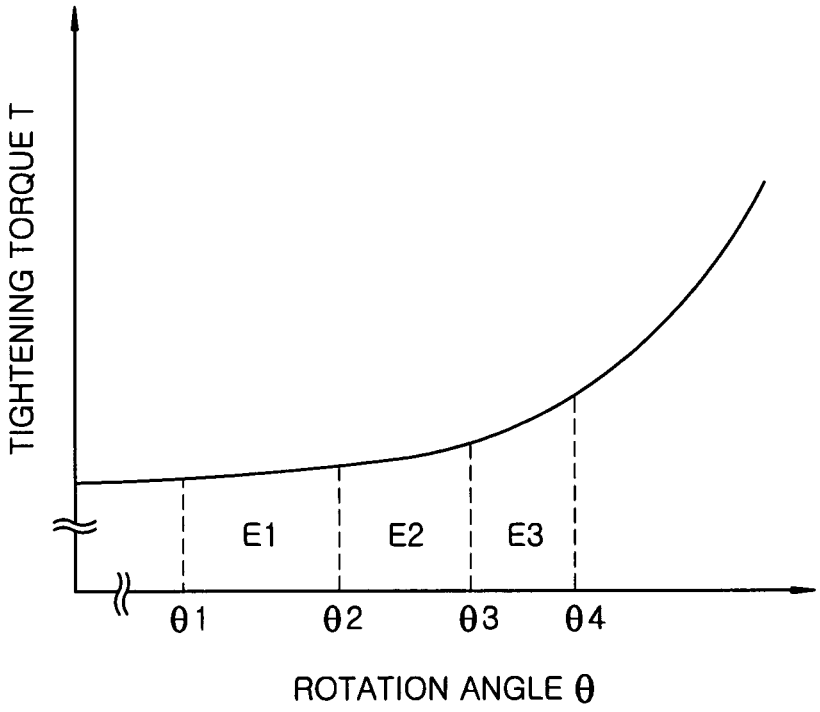
FIG. 3 is a view for explaining the correlation between the tightening torque and the rotation angle in the present impact power tool.

The estimation of the tightening torque performed by the seating detection unit 23 is based on the gain and loss of kinetic energy of every strike. The estimation is made on the premise that the energy delivered to the anvil 5 by the striking action of the hammer 4 is substantially equal to the energy consumed in the tightening operation. Assuming now that the correlation between the rotation angle θ of a nut near the seating time point, and the tightening torque T is represented by the function of $T=\tau(\theta)$ as illustrated in FIG. 3 and further that the strikes made by the hammer 4 occur at respective rotation angles $\theta_1$ through $\theta\mathbf{0}_N$, the value $E_1$ obtained by integrating the function r over the section between $\theta_1$ and $\theta_2$ means the energy consumed in the tightening operation. The value E1 is equal to the energy delivered to the anvil 5 at the time when the anvil 5 is struck by the hammer 4 at rotation angle $\theta_1$. Therefore, the average tightening torque T over the section between $\theta_N$ and $\theta_{N+1}$ is given by equation (1):

$$T_{av=En}/\Delta\theta_n \quad (1)$$

where $E_n$ is the energy and $\Delta\theta_n$ is the rotation angle between consecutive strikes $(\theta_{n+1}-\theta_n)$.

The energy $E_n$ is represented by equation (2):

$$E_n=1/2\times J_a\times\omega n^2 \quad (2)$$

where $J_a$ is the known inertial moment of the anvil 5 and ωn is the striking speed obtained by the striking speed detection unit 24, in which the striking speed calculated from the striking timing detected by the strike detection unit and the rotation angle of the motor detected by the rotation angle detection unit. The anvil rotation angle θ is calculated herein from the correlation of the motor rotation angle between consecutive strikes, the reduction ratio of the speed reducer 2 and the number of strikes applied to the anvil 5 by the hammer 4 during one rotation thereof.

Figure 4:
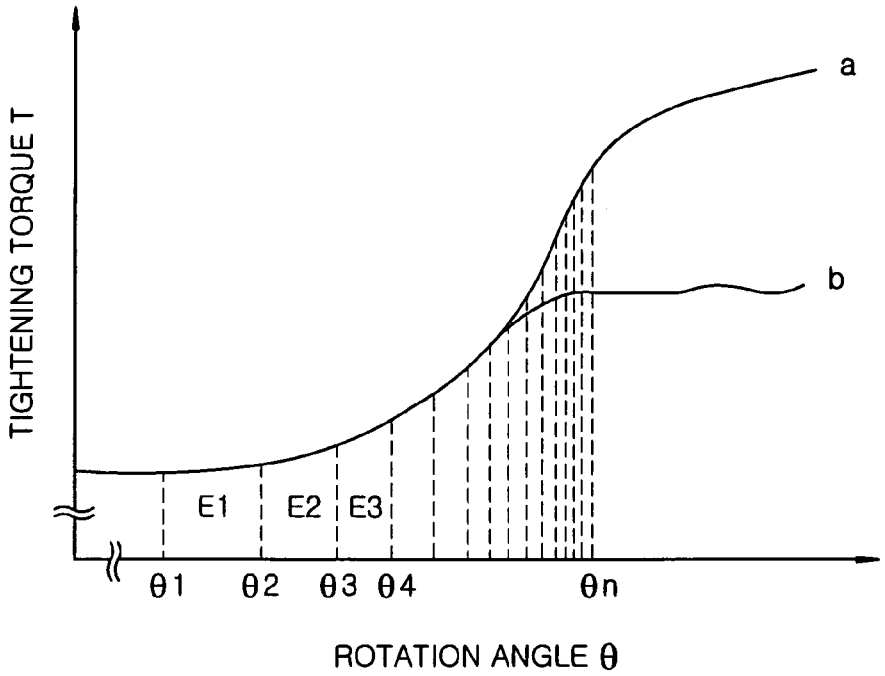
FIG. 4 is a view for explaining the correlation between the tightening torque, the rotation angle and the estimated tightening torque in the present impact power tool.

FIG. 4 shows a change in torque at the time of tightening a bolt. In case of a bolt tightening task for coupling metal bodies together, the tightening torque is gradually increased each time of application of the striking impact as can be clearly seen in FIG. 4. The rotation angle of the bolt in each application of the striking impact is gradually reduced and finally changed to a minute angle. Since the rotation angle of the bolt (the anvil 5) in each application of the striking impact is used in the afore-mentioned calculation for finding the estimated tightening torque T, an error becomes greater in the region where the rotation angle is changed to a small value. Consequently, the estimated tightening torque ("b" in FIG. 4) differs from the actual tightening torque ("a" in FIG. 4). Although it may be possible to mount a rotation angle sensor of high accuracy and high resolution to the anvil 5, this tends to increase the weight of the impact power tool, thereby deteriorating the workability. In addition, the impact power tool becomes complicated in structure and costly to manufacture.

Figure 5:
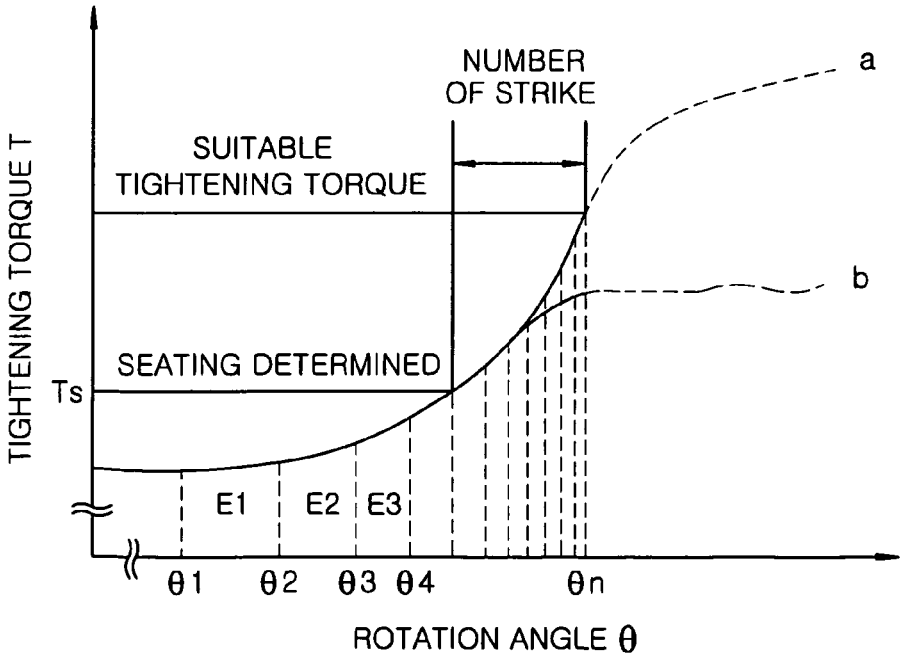
FIG. 5 is a view for explaining the correlation between the tightening torque, the rotation angle and the number of strikes.

It is difficult to determine the seating or non-seating of the bolt based on the number of strikes. Determination of the seating or non-seating based on the estimated tightening torque assures increased accuracy and makes it easy to accurately detect the rotation angle of the bolt each time of application of the striking impact until the seating is completed. In the present embodiment, it is determined that the seating has been completed if the estimated tightening torque T found as above becomes equal to or greater than a predetermined value Ts. The final tightening torque is determined depending on whether the number of strikes after completion of the seating has reached a specified strike number corresponding to a desired tightening torque. Inasmuch as the bolt comes into a stable tightening state after completion of the seating, the tightening torque is also stabilized as illustrated in FIG. 5.

Figure 6:
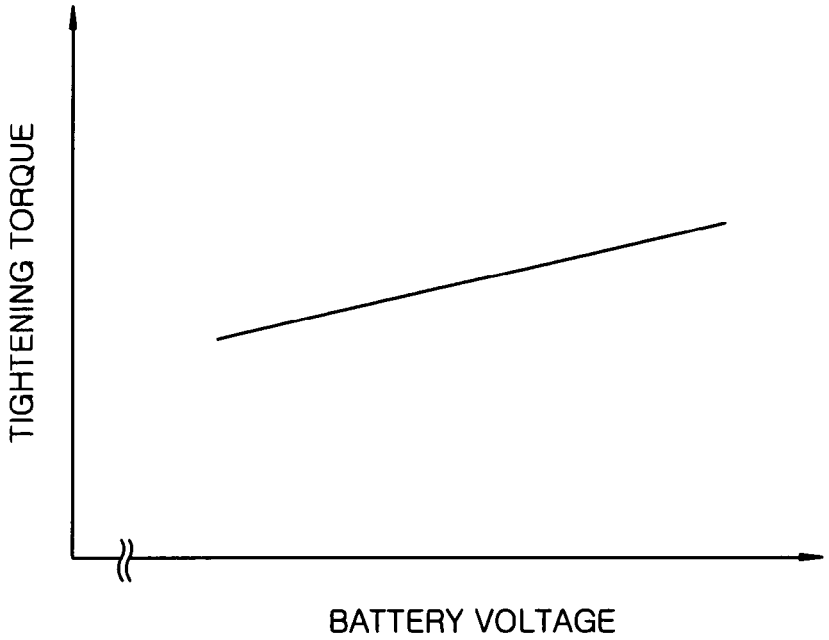
FIG. 6 is a view for explaining the correlation between the tightening torque and the battery voltage.

In this regard, if the determination as to whether the tightening torque has reached a target tightening torque is made based on the number of strikes, the accuracy of repeated determination is reduced as the power source voltage drops as mentioned above. FIG. 6 represents the correlation between the tightening torque and the battery voltage when the number of strikes remains the same.

For the reason noted above, during the control operation in which the number of strikes is counted and the shutoff is performed when the number of strikes thus counted has reached a predetermined strike number corresponding to the target tightening torque, the striking speed ω n of equation (2) is monitored and the predetermined strike number is corrected depending on the striking speed ωn.

Figure 1:
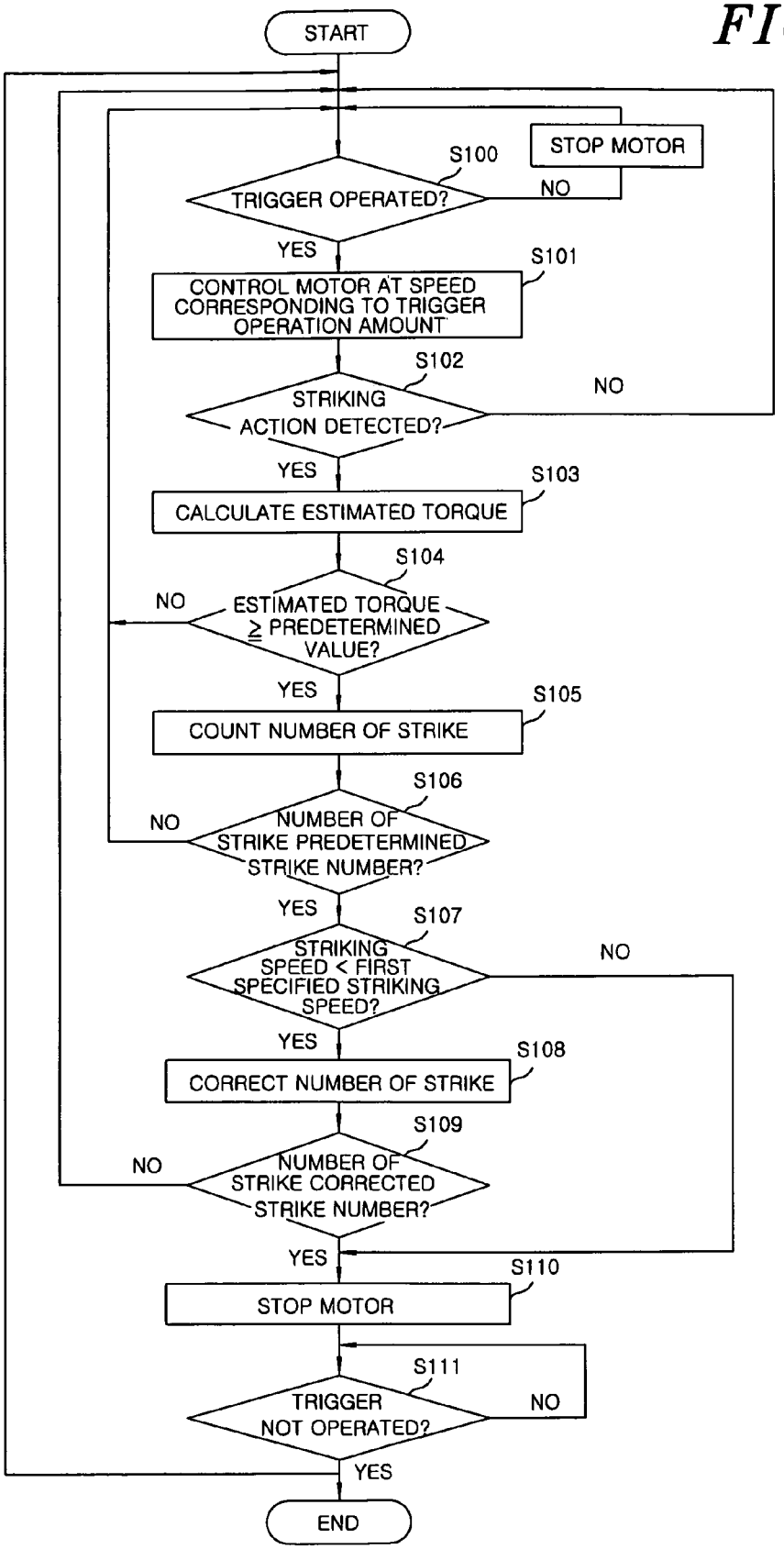
FIG. 1 is a flowchart illustrating the operation of an impact power tool in accordance with one embodiment of the present invention.

Referring to FIG. 1, if the trigger switch 13 is turned on (step S100), the motor 1 is controlled at a rotational speed corresponding to the operation amount of the trigger switch 13 (step S101). Then, if a strike is detected by the strike detection unit 21, the seating detection unit 23 calculates an estimated tightening torque (step S103). The seating is determined in step S104 and the shutoff operation based on the number of strikes is performed in steps S105 through S110. If the estimated tightening torque is equal to or greater than a predetermined value Ts and the seating is determined to have been completed in step S104, the control unit 10 counts the number of strikes in response to the strike signal issued from the strike detection unit 21 (step S105).

If the number of strikes counted has reached the predetermined strike number (step S106) and the striking speed at this time is equal to or greater than a first specified striking speed (the striking speed when the battery voltage is normal) (step S107), the shutoff operation is carried out. In contrast, if the striking speed before stoppage of the tool is smaller than the first specified striking speed, the predetermined strike number is corrected.

In performing the correction, deficient striking energy is calculated by multiplying the predetermined strike number and the difference between the striking energy calculated from the first specified striking speed and the striking energy calculated from the striking speed obtained by the striking speed detection unit 24. The deficient striking energy is converted to a deficient strike number. Then, a corrected strike number is found by adding the deficient strike number to the predetermined strike number. If the number of strikes reaches the corrected strike number (step S109), the motor 1 is stopped to perform the shutoff. More specifically, the deficient striking energy is calculated by the equation: deficient striking energy=((first specified striking speed)$^2$−(actual striking speed)$^2$)×predetermined strike number. Such calculation of the deficient striking energy is based on the notion that the square of the striking speed is proportional to the tightening torque if the rotation angle between consecutive strikes is very small and substantially constant. The conversion of the deficient striking energy to the deficient strike number is performed using the equation:

$$\text{Deficient strike number}=\text{correction coefficient}\times\text{deficient striking energy}\div(\text{actual striking speed})^2.$$

The smaller the striking speed, the greater the deficient strike number. Therefore, it is possible to perform the correction with increased accuracy. The correction coefficient is an arbitrary integer that varies with the kind of the impact power tool.

Figure 7:
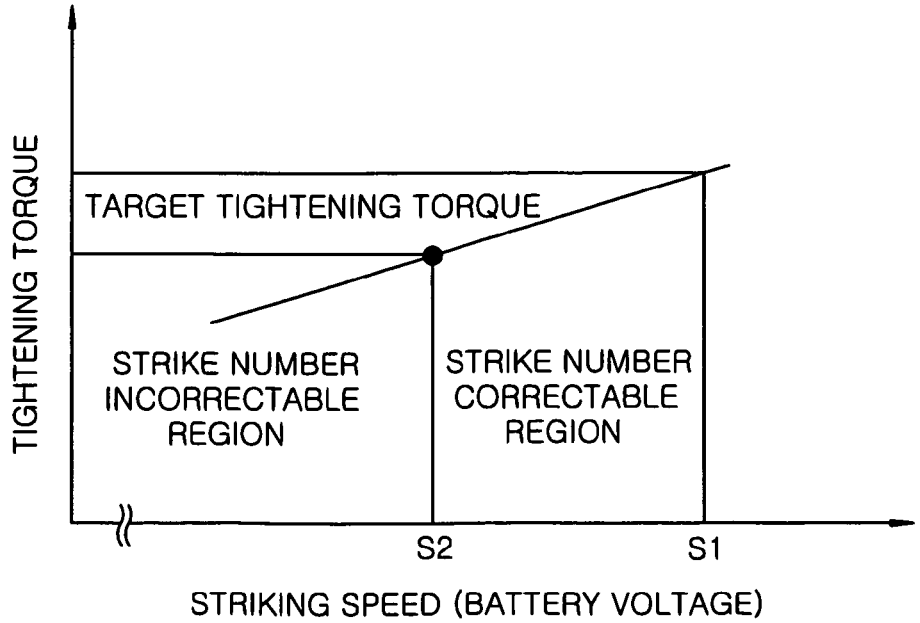
FIG. 7 is a view for explaining the correlation between the tightening torque and the striking speed.

When the striking speed detected is too low, it is impossible to reach the target tightening torque even if the number of strikes is corrected as can be seen in FIG. 7. Although not shown in FIG. 1, it is therefore desirable to stop the motor 1 and urge an operator to replace the battery by notifying the operator of the shortage of power source voltage through light or sound (buzzer sound) using a notification unit 14 shown in FIG. 2, when the striking speed detected is equal to or lower than a second specified striking speed S2 (smaller than the first specified striking speed S1 as illustrated in FIG. 7) at which the target tightening torque cannot be realized by the striking operation in the corrected strike number. If the motor 1 is kept unable to start up until and unless the battery is replaced, it is possible to reliably prevent poor completion of the tightening task which would otherwise result from the deficient tightening torque.

While the invention has been shown and described with respect to the exemplary embodiments, it will be understood by those skilled in the art that the invention is not limited to the foregoing embodiments but various changes and modifications may be made without departing from the scope of the invention.

What is claimed is:

1. An impact power tool comprising:

an impact mechanism for applying a striking impact to an output shaft by using an output power of a motor;

a strike detection unit for detecting the striking impact applied by the impact mechanism to obtain a striking timing;

a rotation angle detection unit for detecting a rotation angle of the motor;

a striking speed detection unit for calculating a striking speed from the striking timing obtained by the strike detection unit and the rotation angle of the motor obtained by the rotation angle detection unit;

a seating detection unit for detecting a seating of an object on a target member by estimating a tightening torque from the striking speed obtained by the striking speed detection unit and the rotation angle of the motor obtained by the rotation angle detection unit, wherein the seating detection unit determines the seating when the estimated tightening torque estimated is equal to or larger than a threshold tightening torque; and a control unit for counting the number of striking impacts detected after the seating and for stopping the motor if the number of striking impacts reaches a predetermined strike number, wherein the control unit is designed to correct the predetermined strike number when the striking speed obtained in the striking speed detection unit is equal to or lower than a specified striking speed.

2. The impact power tool of claim 1, wherein the control unit performs correction of the predetermined strike number by calculating deficient striking energy in such a way that the predetermined strike number is multiplied by the difference between the striking energy calculated from the specified striking speed and the striking energy calculated from the striking speed detected, converting the deficient striking energy to a deficient strike number, and then adding the deficient strike number to the predetermined strike number.

3. The impact power tool of claim 2, wherein the control unit stops the motor and notifies an operator of occurrence of an abnormality in the tightening torque, when the striking speed detected is equal to or lower than a specific striking speed which is smaller than the specified striking speed.

4. The impact power tool of claim 3, wherein the control unit stops the motor and keeps the motor unable to operate, when the striking speed detected is equal to or lower than a specific striking speed which is smaller than the specified striking speed.

5. The impact power tool of claim 2, wherein the control unit stops the motor and keeps the motor unable to operate, when the striking speed detected is equal to or lower than a specific striking speed which is smaller than the specified striking speed.

6. The impact power tool of claim 1, wherein the control unit stops the motor and notifies an operator of occurrence of an abnormality in the tightening torque, when the striking speed detected is equal to or lower than a specific striking speed which is smaller than the specified striking speed.

7. The impact power tool of claim 6, wherein the control unit stops the motor and keeps the motor unable to operate, when the striking speed detected is equal to or lower than a specific striking speed which is smaller than the specified striking speed.

8. The impact power tool of claim 1, wherein the control unit stops the motor and keeps the motor unable to operate, when the striking speed detected is equal to or lower than a specific striking speed which is smaller than the specified striking speed.

* * * * *